US005090551A

United States Patent [19]

Yasuhara et al.

[11] Patent Number: 5,090,551

[45] Date of Patent: Feb. 25, 1992

[54] MAN CONVEYOR

[75] Inventors: Yoshihito Yasuhara; Toshio Saitou, both of Tokyo, Japan

[73] Assignee: Kabushiki Kaisha Toshiba, Kawasaki, Japan

[21] Appl. No.: 658,294

[22] Filed: Feb. 20, 1991

[30] Foreign Application Priority Data

Feb. 20, 1990 [JP] Japan ..... 2-37188
Mar. 8, 1990 [JP] Japan ..... 2-54855

[51] Int. Cl.[5] ..... B66B 9/00
[52] U.S. Cl. ..... 198/323; 198/331
[58] Field of Search ..... 198/322, 323, 331

[56] References Cited

U.S. PATENT DOCUMENTS 1,984,801 12/1934 Lindquist et al. ..... 198/323
4,664,247 5/1987 Wolf et al. ..... 198/323

FOREIGN PATENT DOCUMENTS 61-29314 7/1986 Japan .
63-143191 6/1989 Japan .

*Primary Examiner*—Joseph E. Valenza
*Attorney, Agent, or Firm*—Oblon, Spivak, McClelland, Maier & Neustadt

[57] ABSTRACT

A conveyer for transporting people includes a transmitting mechanism for transmitting the drive force of a treadboard driving section for moving treadboards to a drive mechanism of a handrail driving section for moving handrails. The transmitting mechanism includes a transmission shaft on which first and second junction sprockets are fixed, a first drive chain stretched between the treadboard driving section and the first junction sprocket, and a second drive chain stretched between the second junction sprocket and the drive mechanism. A detecting device is arranged to detect a twist of the transmission shaft attributable to the difference between loads acting on the first and second junction sprockets. The device detects a change in the moving sped of the handrail in accordance with the detected twist of the shaft.

8 Claims, 8 Drawing Sheets

MAN CONVEYOR

BACKGROUND OF THE INVENTION

1. Field of the Invention

The present invention relates to conveyor for transporting people, such as escalators, moving sidewalk, etc.

2. Description of the Related Art

As a conventional example of the conveyor of this type, an escalator with a handrail drive unit of a winding drive type is disclosed in Published Examined Japanese Patent Application No. 61-29314. According to this system, one relatively large handrail driving wheel is rotated in association with a treadboard drive section for driving a large number of treadboards, and a moving handrail, which is wound half round the driving wheel, is driven by the resulting force of rolling friction.

Meanwhile, there is a social demand for efficient use of the floor space of buildings. To meet this demand, the effective area of the buildings must be increased by minimizing the installation space for escalators. As is also described in the aforesaid patent application, therefore, handrail drive units of a straight drive type have started to be widely used. This system, unlike the winding drive system, permits reduction in both width and depth of the escalators. According to the straight drive system, a handrail is vertically held between a plurality of rollers, which are rotated in association with a treadboard drive section so that the handrail is driven frictionally.

In either of these two drive systems, a heavy load sometimes may act on the moving handrail while it is traveling, thereby changing the traveling speed of the handrail. In such a case, the treadboards and the moving handrail, which originally are expected to move in synchronism and at the same speed with one another, cease to be synchronous, so that users or passengers cannot keep their balance on the treadboards, exposing themselves to danger.

Thus, in the conventional conveyor, as described in Published Unexamined Japanese Patent Application No. 63-143191, for example, the traveling speed of the moving handrail and the driving speed of the treadboard drive section are detected individually, and the change of the handrail speed is detected by comparing the two speeds. If the change of the handrail speed is detected in this manner, that is, if there is a difference between the detected speeds, an alarm is given or the drive of the escalator is stopped for safety's sake.

In the conveyor described above, however, a sensor for detecting the traveling speed of the moving handrail and a sensor for detecting the driving speed of the treadboard drive section are provided independently of each other in separate positions. Accordingly, the sensor means requires a wide setting space, and the mounting work, maintenance, and inspection for the sensor means are time-consuming.

SUMMARY OF THE INVENTION

The present invention has been contrived in consideration of these circumstances, and its object is to provide a conveyor capable of securely detecting the change of the speed of a moving handrail without requiring a wide setting space for a detecting device.

In order to achieve the above object, a conveyor according to the present invention comprises: a body frame; a large number of treadboards supported on the body frame for movement along a predetermined path; a moving handrail supported on the body frame for movement along a predetermined path; first drive means for moving the treadboards; second drive means for moving the handrail in interlock with the first drive means, the second drive means including a handrail drive section engaging the handrail, and means for transmitting the driving force of the first drive means to the handrail drive section, the transmitting means including a transmission shaft rotatably supported on the body frame, first and second engaging sections provided on the transmission shaft so as to be rotatably integrally therewith and spaced in the axial direction of the transmission shaft, a first power transmission member stretched between the first drive means and the first engaging section, for rotating the transmission shaft in interlock with the first drive means, and a second power transmission member stretched between the second engaging section and the handrail drive section, for driving the handrail drive section in interlock with the rotation of the transmission shaft; and means for detecting a change of the moving speed of the moving handrail by detecting a twist of the transmission shaft attributable to the difference between loads acting on the first and second engaging sections.

According to the conveyor constructed in this manner, if a heavy load acts on the moving handrail to change its running speed, a difference is caused between loads acting on the first and second engaging sections on the transmission shaft, so that the transmission shaft undergoes a twist. The change of the speed of the moving handrail can be detected by detecting this twist by means of the detecting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 5 show an escalator according to a first embodiment of the present invention, in which;

FIG. 1 is a side view schematically showing the whole escalator;

FIG. 2 is a side view showing the principal part of the escalator cleared of its cover;

FIG. 3 is a plan view showing part of a transmission mechanism;

FIG. 4 is a sectional view taken along line IV—IV of FIG. 3;

FIG. 5 is a block diagram of a detecting device;

FIGS. 7 to 9 show a second embodiment of the invention, in which FIG. 7 is a plan view showing part of a transmission mechanism;

FIG. 8 is a sectional view taken along line VIII—VIII of FIG. 7;

FIG. 9 is a perspective view showing a fixed shaft of a transmission shaft;

FIGS. 10 and 11 show a third embodiment of the present invention, in which;

FIG. 10 is a plan view showing part of a transmission mechanism; and

FIG. 11 is a perspective view schematically showing a transmission shaft and a detecting device.

DETAILED DESCRIPTION OF THE PREFERRED EMBODIMENTS

Preferred embodiments of the present invention will now be described in detail with reference to the accompanying drawings.

FIGS. 1 to 5 show an escalator according to a first embodiment of the invention.

Figure 1:
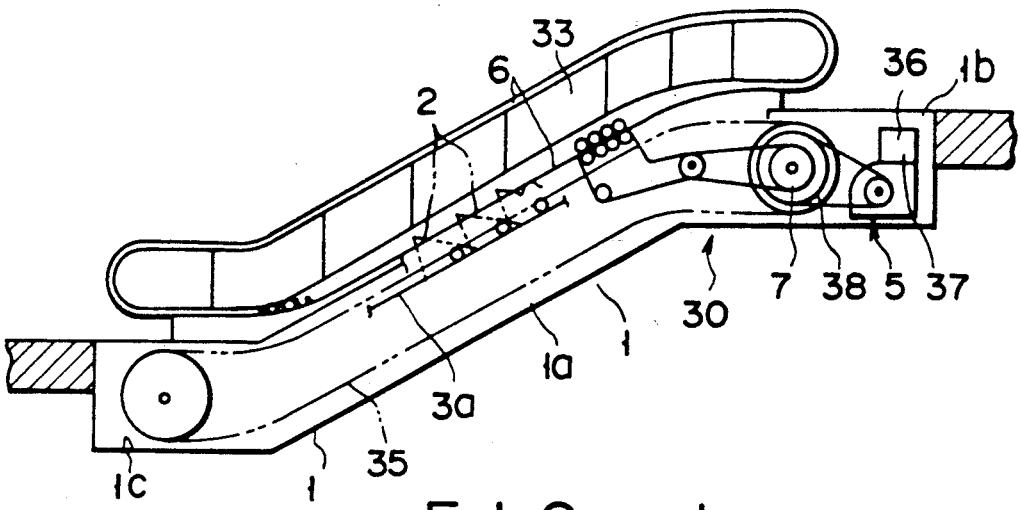

As shown in FIG. 1, the escalator comprises right and left side wall sections facing each other and a bottom wall section connected thereto, these sections constituting a body frame 1 of a truss structure. The frame 1, which is covered by a decorative panel, includes a slope section 1*a* extending in a straight line inclined at a predetermined angle, an upper-floor horizontal section 1*b* extending horizontally from the upper end of the slope section, and a lower-floor horizontal section 1*c* extending horizontally from the lower end of the slope section.

Arranged between the opposite side walls of the body frame 1 are treadboards 2 (mentioned later) which carry people thereon. A balustrade 33 is set up on each side wall so as to extend substantially over the full length of the side wall. Each balustrade 33 is fitted with a moving handrail 6 on which people lay their hands. Various mechanisms for driving the treadboards 2 and the handrails 6 are disposed in the side walls. Since these mechanisms are arranged symmetrically with respect to the center line between the two side walls, only the construction on one side of the escalator will now be described in detail.

Figure 2:
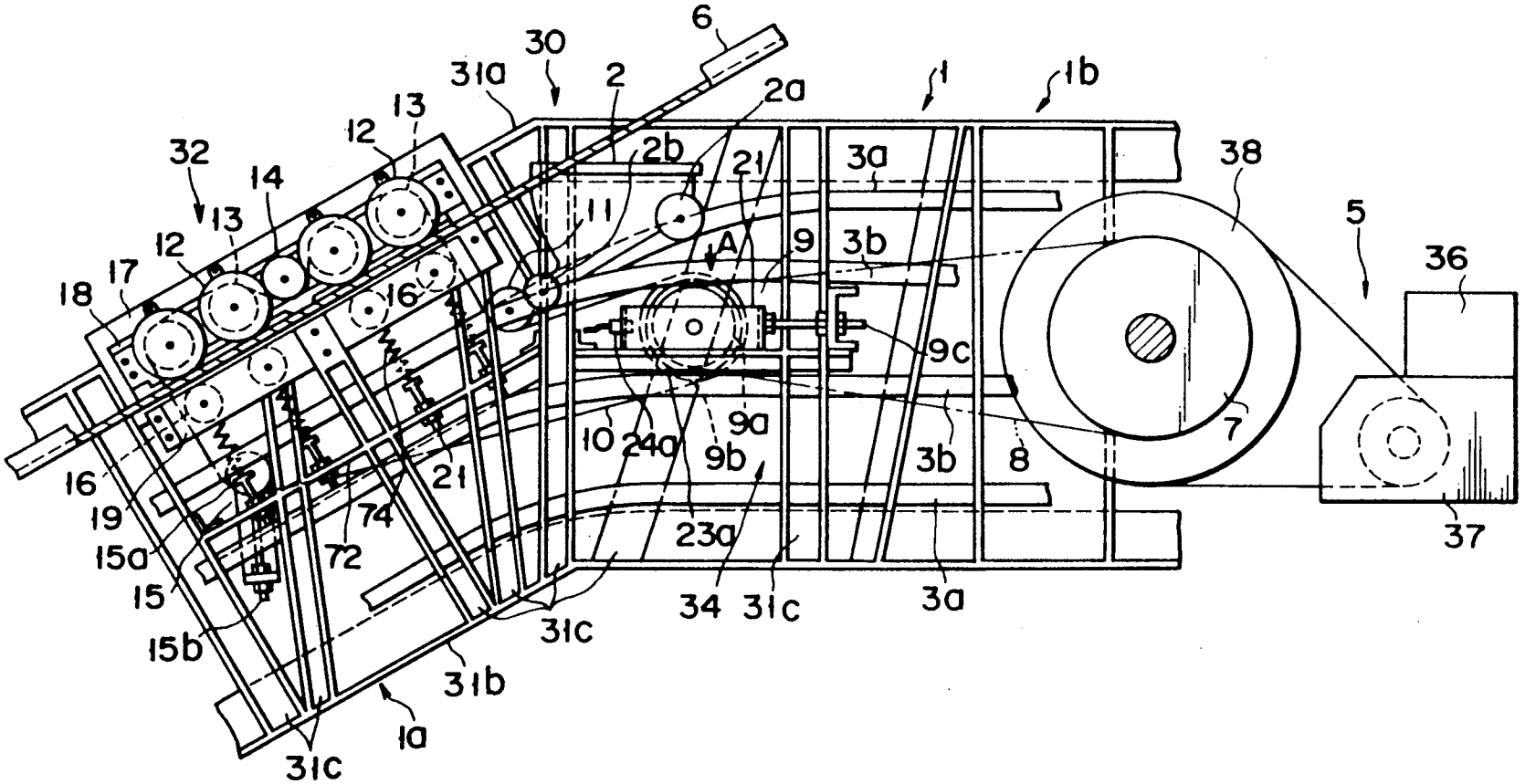

As shown in FIGS. 1 and 2, the escalator comprises a large number of treadboards 2 arranged between the right and left side walls. The treadboards 2 are connected to one another by means of right and left treadboard chains 35, thus forming an endless belt on each side. A front wheel 2*a* and a rear wheel 2*b* are rotatably mounted on each side wall of each treadboard 2. The body frame 1 is provided with upper and lower guide rails 3*a* and 3*b* arranged each in the form of a loop extending along the side wall of the frame 1. Each treadboard 2 can travel in a loop along the side walls of the escalator while its front and rear wheels 2*a* and 2*b* are guided by the rails 3*a* and 3*b*, respectively.

A treadboard drive section 5 for driving the treadboards 2 is located in the upper-floor horizontal section 1*b* of the body frame 1. The drive section 5 includes a motor 36, a speed reducer 37, a treadboard chain driving sprocket 38, and a handrail driving sprocket 7 provided coaxially with the sprocket 38 so as to be rotatable integrally therewith.

The moving handrail 6, which is arranged in a loop extending through the outer periphery of the balustrade 33, is partially guided through the body frame 1. The handrail 6 is driven to travel in synchronism with the treadboards 2 by means of a handrail drive mechanism 30, which will be described below.

Figure 3:
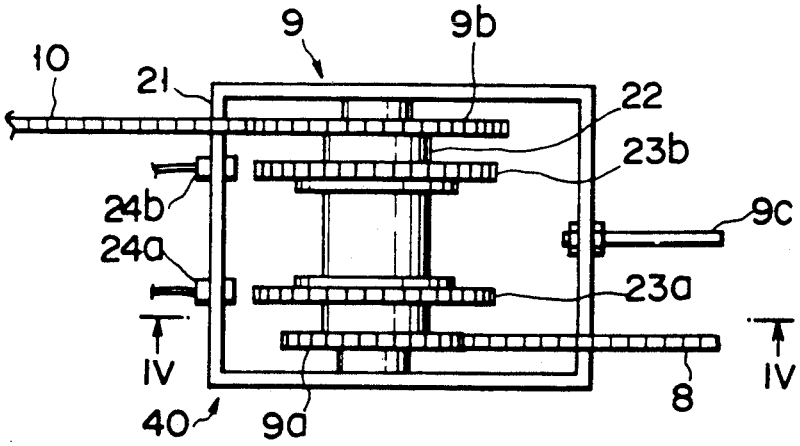

As shown in FIGS. 2 and 3, the handrail drive mechanism 30 includes a drive section 32 for driving the moving handrail 6 by engaging the same, and a transmission mechanism 34 for transmitting the driving force of the treadboard drive section 5 to the drive section 32. The transmission mechanism 34 has a junction unit 9, which includes a rectangular support frame 21, located inside the upper-floor horizontal section 1*b* of the body frame 1 at a position near the slope section 1*a*, and a transmission shaft 22 rotatably supported on the frame 21. First and second junction sprockets 9*a* and 9*b*, for use as first and second engaging portions, are fixed individually to the two opposite end portions of the transmission shaft 22 so as to be coaxial therewith. A first handrail drive chain 8 is passed around and between the sprocket 9*a* and the handrail driving sprocket 7 of the treadboard drive section 5, while a second handrail drive chain 10 is passed around and between the sprocket 9*b* and the drive section 32.

The drive section 32, which is located at the slope section 1*a* of the body frame 1, includes a plurality of handrail driving wheels 12, e.g., four in number, arranged straight along the slope section so as to be in contact with the upper surface of the handrail 6, driving sprockets 13 fixed individually to the wheels 12 so as to be coaxial therewith, and an intermediate sprocket 14 interposed between the sprockets 13.

The second handrail drive chain 10, which is wound around the second junction sprocket 9*b*, is guided upward to be wound successively around the driving sprockets 13 and the intermediate sprocket 14, after being wound around a guide sprocket 11, which is supported inside the slope section 1*a* of the body frame 1. Then, the chain 10 is guided downward from the last driving sprocket 13 to be wound around a tension sprocket 15*a* of a tensioner 15, whereupon it is returned to the sprocket 9*b*.

The support frame 21 of the junction unit 9 is mounted so as to be horizontally shiftable with respect to the body frame 1, and is provided with an adjusting stud 9*c* for tension adjustment. The tension of the first handrail drive chain 8 can be adjusted by operating the stud 9*c* to move the frame 21 away from the handrail driving sprocket 7. The tension sprocket 15*a* of the tensioner 15 is movable vertically, and the tensioner 15 is provided with a tension adjusting stud 15*b*. The tension of the second handrail drive chain 10 can be adjusted by operating the stud 15*b* to pull the sprocket 15*a* vertically.

When the handrail driving sprocket 7 of the treadboard drive section 5 is rotated integrally with the treadboard chain driving sprocket 38, the transmission shaft 22 is rotated in interlock with the sprocket 7 by means of the first handrail drive chain 8 and the first junction sprocket 9*a*. Accordingly, the handrail driving wheels 12 are rotated by means of the second junction sprocket 9*b* and the second handrail drive chain 10, whereby the moving handrail 6 is driven frictionally.

Four rolling wheels 16 are arranged under the moving handrail 6 in order to transmit the frictional driving force of the driving wheels 12 securely to the handrail. The wheels 16 face their corresponding driving wheels 12 with the handrail 6 between them. These rolling wheels 16 are rotatably mounted on a wheel support frame 19, which is attached to the body frame 1 for up-and-down motion. The support frame 19 is pressed toward the moving handrail 6 by means of a plurality of studs 72 and backup springs 74 attached to a fixed frame 20 of the body frame 1. Thus, the rolling wheels 16 press the handrail 6 against their corresponding driving wheels 12, thereby holding the handrail in conjunction with the wheels 12. The force of pressure contact between the handrail 6 and the rolling wheels 16 can be adjusted by means of the studs 72.

The body frame 1 is composed of upper and lower chords 31*a* and 31*b* of angle steel and a large number of stringers 31*c* of channel steel or the like stretched between the chords 31*a* and 31*b*. The treadboard drive section 5, junction unit 9, guide sprocket 11, tensioner 15, etc. are attached individually to the stringers 31*c* in suitable positions therefor.

An inwardly bent portion of the upper chord 31 of angle steel is notched for a predetermined length lest the width of the body frame 1 be increased and in order to secure a space for the handrail driving wheels 12 and the sprockets 13 coaxial therewith, arranged over the outside of the upper guide rail 3*a* for the front wheels. A thick plate 17, which doubles as a reinforcing member for the frame 1, is fixed to the notched portion by welding, and a driving wheel frame 18 is fixed to the plate 17 by means of bolts or the like. The handrail driving wheels 12, sprockets 13, and intermediate sprocket 14 are mounted on the frame 18.

Figure 4:
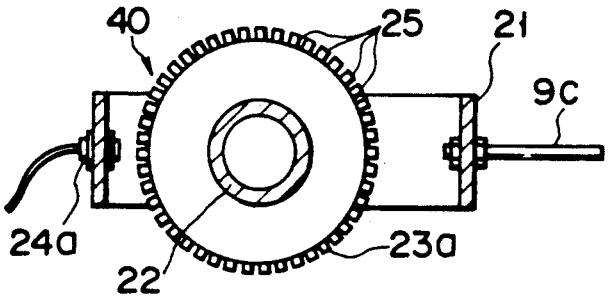

As shown in FIGS. 3 and 4, the junction unit 9 is provided with a detecting device 40 for detecting the change of the speed of the moving handrail 6. More specifically, a first disk-shaped detection target 23*a* is fixed to one end portion of the transmission shaft 22 so as to be coaxial therewith, adjoining the first junction sprocket 9*a*. Also, a second disk-shaped detection target 23*b* is fixed to the other end portion of the shaft 22 so as to be coaxial therewith, adjoining the second junction sprocket 9*b*. The first and second targets 23*a* and 23*b* have the same diameter. A large number of projections 25 are at regular intervals on the outer peripheral surface of each detection target, the distal end face of each projection constituting a reflective surface. The support frame 21 is fitted with first and second sensors 24*a* and 24*b* for rotation detection, which face circumferential surfaces of the first and second detection targets 23*a* and 23*b*, respectively. The sensors 24*a* and 24*b*, which are each formed of a photosensor including a light emitting element and a light receiving element, receive reflected light beams from the respective circumferential surfaces of the targets 23*a* and 23*b*, and deliver pulse signals. The pulse signals from the first sensor 24*a* are accurately proportional to the rotating speed of the first detection target 23*a*, that is, the moving speed of the treadboards 2. Likewise, the pulse signals from the second sensor 24*b* are accurately proportional to the rotating speed of the second detection target 23*b*, that is, the moving speed of the moving handrail 6.

Figure 5:
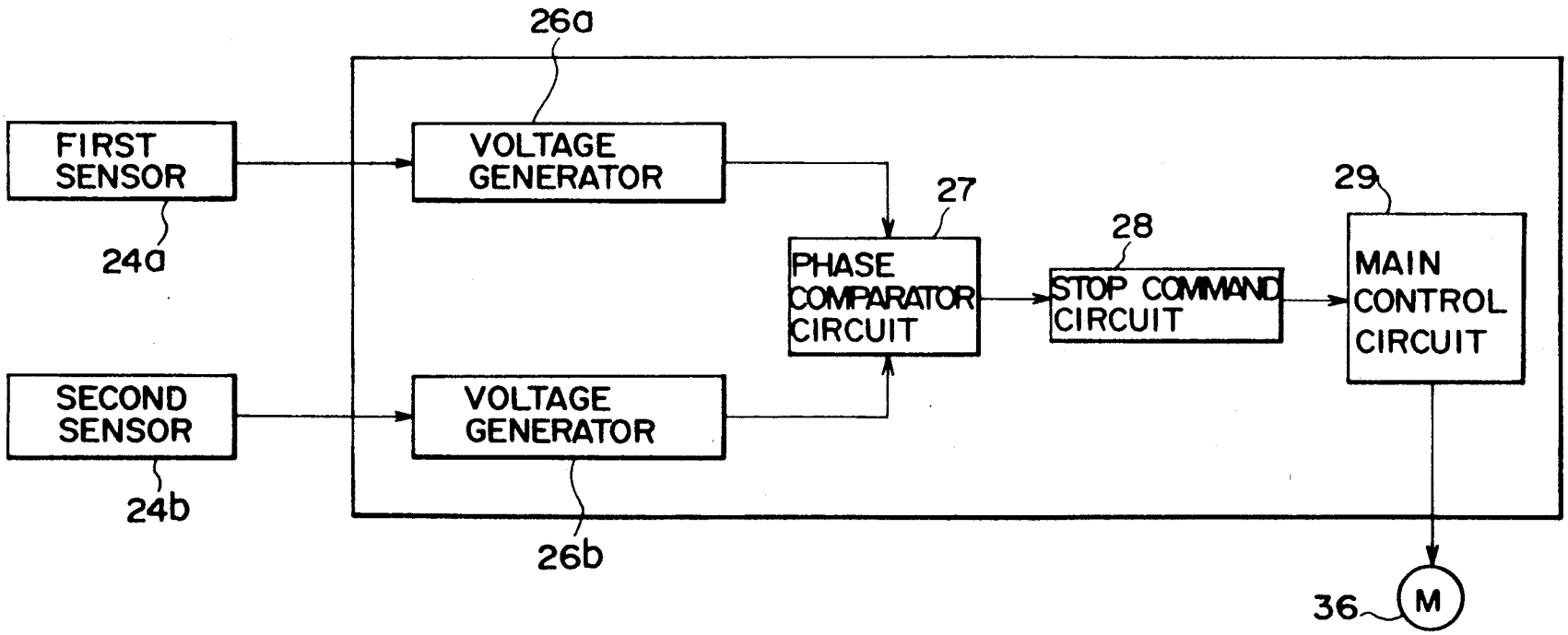

As shown in FIG. 5, the first and second sensors 24*a* and 24*b* are connected to voltage generators 26*a* and 26*b*, respectively, for generating voltages in response to input pulses. Output signals from the generators 26*a* and 26*b* are compared by means of a comparator circuit 27. The circuit 27 is connected to a main control circuit 29 of the escalator through a stop command circuit 28.

According to the escalator constructed in this manner, when the treadboard drive section 5 is actuated to rotate the treadboard chain driving sprocket 38 and the handrail driving sprocket 7, the treadboards 2 are run along the guide rails 3*a* and 3*b* by means of the treadboard chains 35. At the same time, the transmission shaft 22 is rotated by means of the first handrail drive chain 8 and the first junction sprocket 9*a*, and the driving wheels 12 of the handrail drive section 32 is rotated by means of the second junction sprocket 9*b* and the second handrail drive chain 10. Thus, the moving handrail 6 is run in interlock with the treadboards 6 at a speed substantially equal to the traveling speed of the treadboards.

Figure 6:
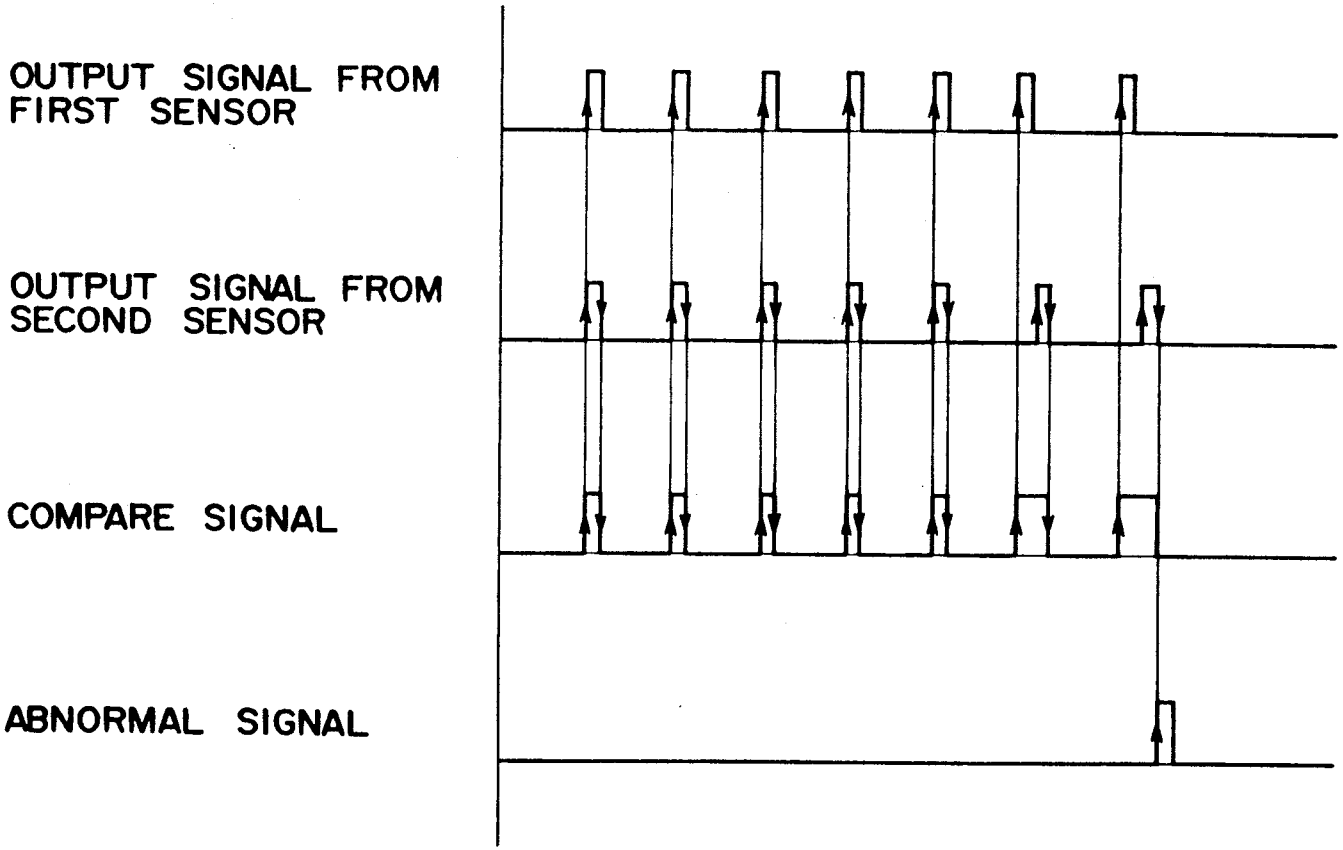
FIG. 6 is a diagram showing detection signals from sensor means.

While the moving handrail 6 is traveling in this manner, the first and second detection targets 23*a* and 23*b* are rotated together with the transmission shaft 22, and their projections 25 are detected by means of the first and second sensors 24*a* and 24*b*. Thus, the sensors 24*a* and 24*b* deliver the pulse signals, as shown in FIG. 6. When the escalator is in a normal operating state, the pulse signals on the side of the treadboard drive section 5 are in synchronism with the ones on the side of the handrail drive mechanism 30.

If a heavy load acts on the moving handrail 6 to increase its running resistance, however, the running speed of the handrail lowers, so that a difference is caused between loads acting on the sprockets 9*a* and 9*b* which are fixed individually to the opposite end portions of the transmission shaft 22 of the junction unit 9. As a result, a torsional torque is produced in the shaft 22, so that a phase difference is caused between the pulse signals from the sensors 24*a* and 24*b* which should be in synchronism with one another.

If the phase difference or an output signal from the comparator circuit 27 exceeds a predetermined allowable value, and if two or more excessive output signals are consecutively delivered, the stop command circuit 28 judges this situation to be abnormal, and delivers an abnormal signal. In response to this abnormal signal, the main control circuit 29 gives an alarm or stops the operation of the motor 36 of the drive section 5, thereby stopping the drive of the escalator.

According to the escalator of the present embodiment, as described above, the detecting device 40 detects the change of the speed of the moving handrail 6 by detecting a twist of the transmission shaft 22 of the junction unit 9. Accordingly, the first and second sensors 24*a* and 24*b* must be located only near the junction unit 9. In contrast with the conventional case, therefore, the detecting device 40 need not be provided at a plurality of positions, so that a wide setting space need not be secured for the detecting device. Further, the detecting device 40 can enjoy a simple construction, and the mounting work, maintenance, and inspection for the device are very easy.

Figure 7:
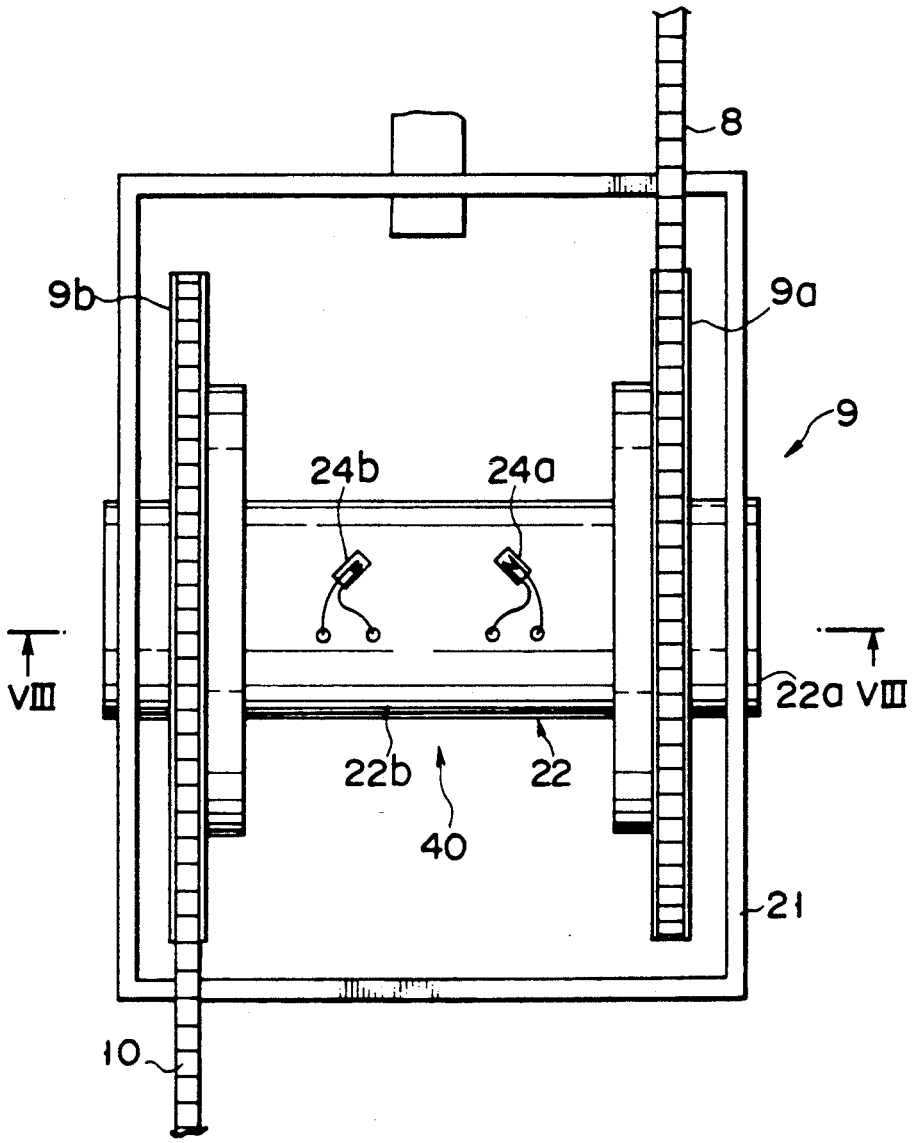
Figure 8:
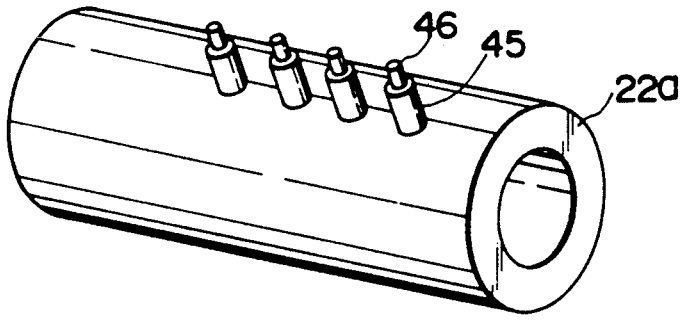
Figure 9:
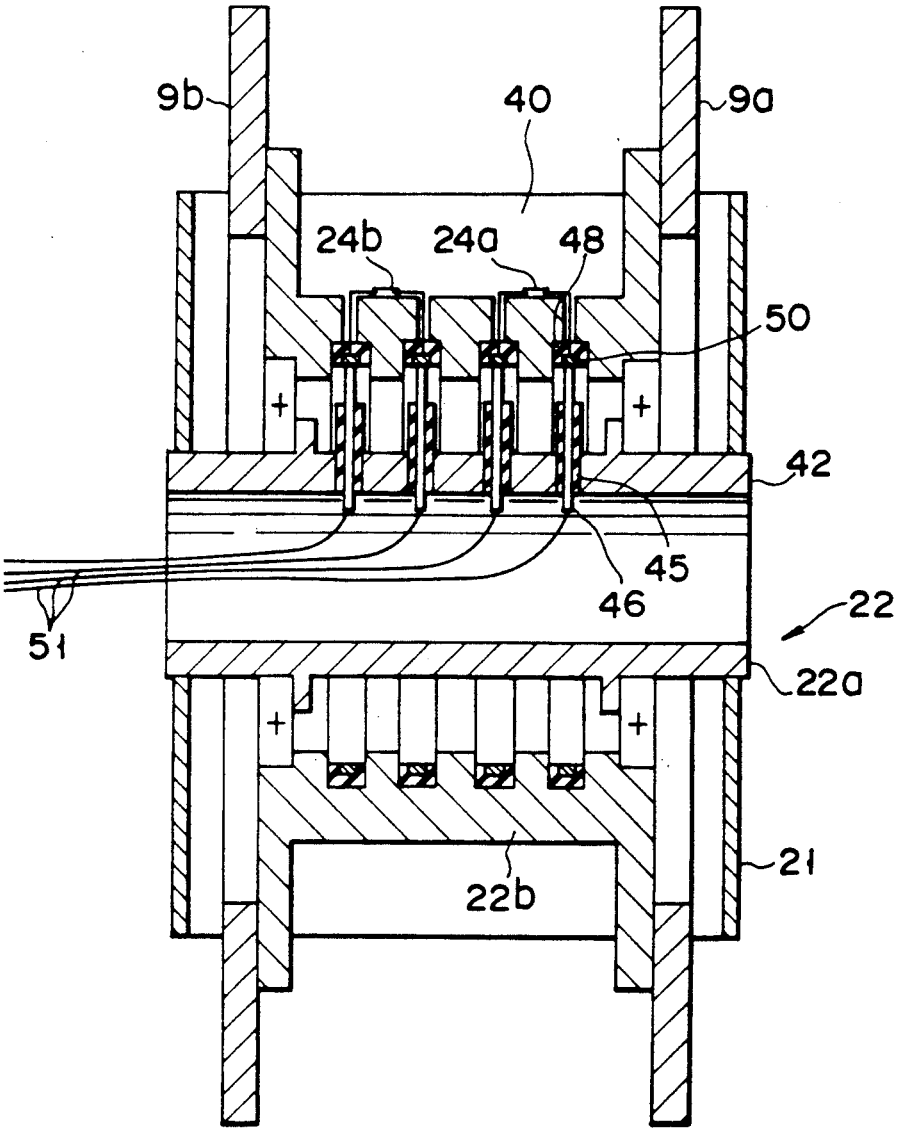

The present invention is not limited to the embodiment described above. As in a second embodiment shown in FIGS. 7 to 9, the twist of the transmission shaft 22 of the junction unit 9 may be detected by means of a detecting device 40 which includes first and second strain sensors.

According to this second embodiment, the transmission shaft 22 includes a fixed shaft 22*a*, fixed to the support frame 21 of the junction unit 9, and a cylindrical rotating shaft 22*b* rotatably supported on the outer circumference of the fixed shaft by means of a pair of bearings 44. Four conductor rods 46, which are coated all over with an insulator 45 except their distal ends, are fixed to the fixed shaft 22*a* so as to project radially therefrom. Four conductor wheels 50, whose outer circumferential portions are coated with an insulator 48, are attached to the inner circumferential surface of the rotating shaft 22*b* and in contact with the respective extended ends of their corresponding rods 46. First and second strain sensors 24*a* and 24*b*, which are fixed to the outer circumferential surface of the shaft 22*b*, are situated near first and second junction sprockets 9*a* and 9*b*, respectively. Each sensor has a pair of output terminals, which are connected electrically to their corresponding conductor wheels 50. Outputs from the sensors 24*a* and 24*b*, like the ones according to the first embodiment, are transmitted to the comparator circuit, the stop command circuit, and the main control circuit through the conductor wheels 50, the conductor rods 46, and lead wires 51.

According to the second embodiment constructed in this manner, if a heavy load acts on the moving handrail 6 to twist the rotating shaft 22*b*, a difference is caused between the respective outputs of the first and second sensors 24*a* and 24*b*. If this output difference continues to be higher than a predetermined allowable value for a predetermined period of time, the main control circuit gives an alarm or stops the drive of the escalator, as in the first embodiment.

Also according the second embodiment constructed as aforesaid, the speed change of the moving handrail 6 is detected by detecting the twist of the transmission shaft 22 of the junction unit 9, so that the same advantages of the first embodiment can be obtained.

The strain sensors may alternatively be provided on the inner circumferential surface of the rotating shaft 22*b*.

Figure 10:
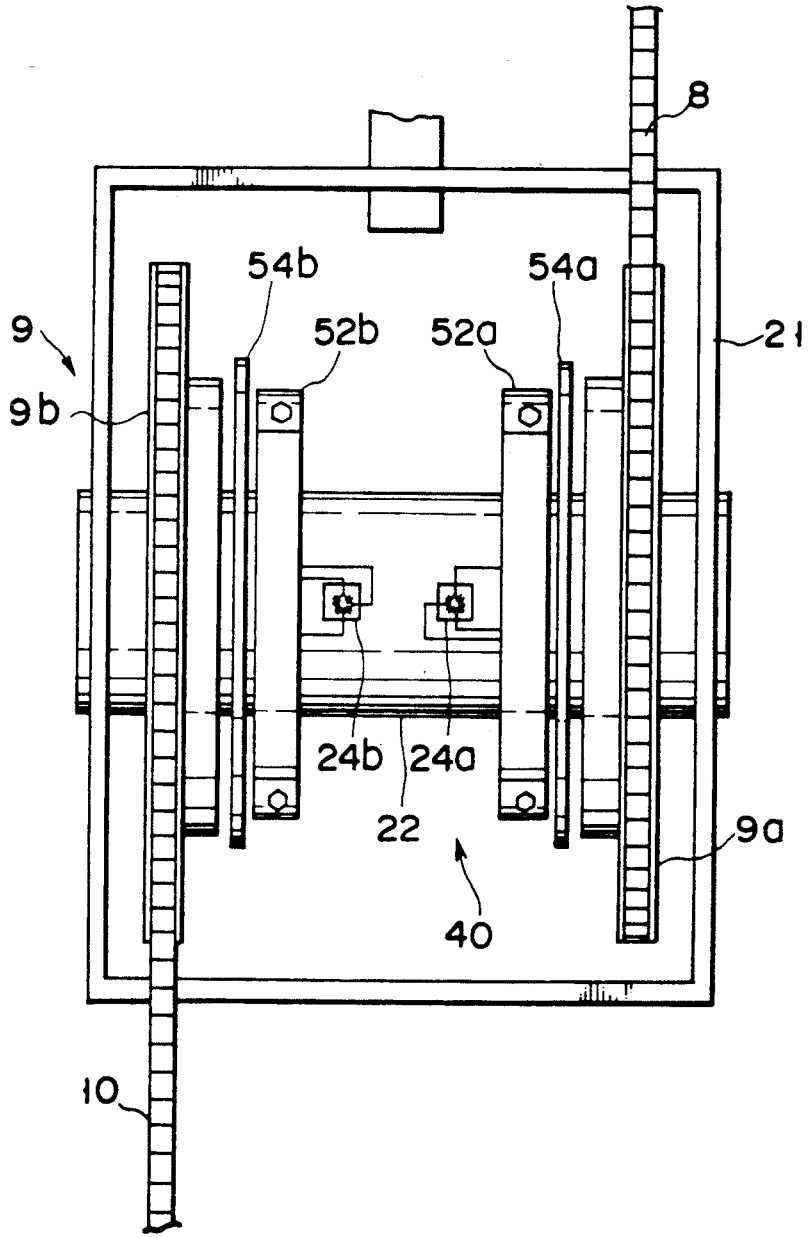
Figure 11:
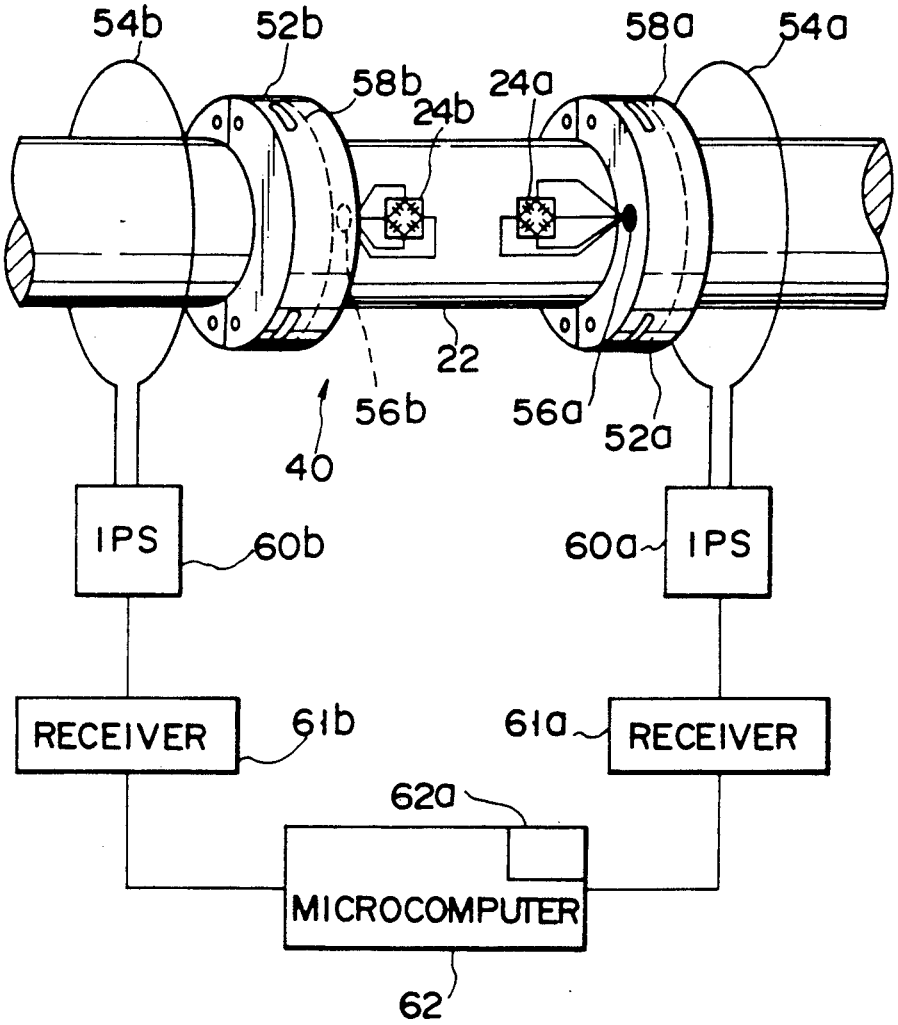

FIGS. 10 and 11 show a third embodiment of the present invention. According to this embodiment, a detecting device 40 includes a first strain sensor 24*a*, a first clamp collar 52*a*, and a first antenna loop 54*a*, which are arranged at the one end portion of the transmission shaft 22 to which the first junction sprocket 9*a* is fixed. The device 40 further includes a second strain sensor 24*b*, a second clamp collar 52*b*, and a second antenna loop 54*b*, which are arranged at the end portion of the shaft 22 to which the second junction sprocket 9*b* is fixed.

The clamp collars 52*a* and 52*b* have an annular shape and are clamped to the outer circumference of the transmission shaft 22 by means of bolts. Arranged in each clamp collar are a rotary transmitter 56*a* (56*b*) and a ring-shaped transmitting antenna 58*a* (58*b*). The first and second strain sensors 24*a* and 24*b*, which are fixed to the outer circumferential surface of the shaft 22, are connected to the transmitters 56*a* and 56*b*, respectively.

The first antenna loop 54*a* is disposed surrounding the transmission shaft 22 so as not to be in contact with the outer surface thereof, and adjoins or faces the clamp collar 52*a*. The loop 54*a*, which constitutes a primary coil, is connected to a microcomputer 62 through an inductance power source (IPS) 60*a* and a receiver 61*a*. Likewise, the second antenna loop 54*b* is disposed surrounding the shaft 22 so as not to be in contact with the outer surface thereof, and adjoins or faces the clamp collar 52*b*. The loop 54*b*, which constitutes a primary coil, is connected to the microcomputer 62 through an IPS 60*b* and a receiver 61*b*.

When a load torque is produced in the transmission shaft 22, the sensor 24*a* generates an electric signal corresponding to the torque. This signal is pulse-width-modulated by means of the transmitter 56*a* and further FM-modulated, whereupon it is applied to the IPS 60*a* via the transmitting antenna 58*a* and antenna loop 54*a*. The IPS 60*a* divides the input signal into parts, an induced power component and a high-frequency component. The high-frequency component is converted into a digital signal proportional to the load torque by means of the receiver 61*a*, and is then applied to a comparator circuit 62*a* of the microcomputer 62. Voltage is applied to the sensor 24*a* and the transmitter 56*a* by means of a magnetic coupling of primary and secondary coils. The same signal processing and voltage supply are also effected with respect to the side of the second strain sensor 24*b*.

According to the third embodiment constructed in this manner, if a heavy load acts on the moving handrail 6 of the escalator to twist the transmission shaft 22, a difference is caused between torsional torques at the two opposite end portions of the shaft 22, detected on the basis of output signals from the first and second sensors 24*a* and 24*b*. This difference is detected by means of the comparator circuit 62*a* of the microcomputer 62. If the difference exceeds a predetermined allowable value, the microcomputer 62 judges this situation to be abnormal, and gives an alarm or stops the drive of the escalator.

Also according to the third embodiment constructed as aforesaid, the detecting device 40 detects the change of the speed of the moving handrail 6 by detecting the twist of the transmission shaft 22 of the junction unit 9. Accordingly, the strain sensors 24*a* and 24*b* must be located only near the junction unit 9, so that a wide setting space need not be secured for the detecting device.

In contrast with the conventional case, therefore, the sensors need not be provided at a plurality of positions, and can enjoy a simple construction. Further, the mounting work, maintenance, and inspection for the sensor means are very easy. Since the receiving section, including the antenna loops 54*a* and 54*b* and the IPS 60*a* and 60*b*, used to receive the output signals from the sensors, is arranged out of contact with the transmission shaft 22, moreover, the maintenance and mounting work for the receiving section are easy. Since the clamp collars 52*a* and 52*b* can be fixed to the transmission shaft 22 by means of the bolts, furthermore, the detecting device 40 can be easily attached to the junction unit of an existing escalator without requiring any special work.

Although the strain sensors 24*a* and 24*b* are arranged on the outer circumference of the transmission shaft 22, they may alternatively be located on the inner circumference thereof.

It is to be understood that the present invention is not limited to the embodiments described above, and that various changes and modifications may be effected therein by one skilled in the art without departing from the scope of the invention. For example, the invention is not limited to escalators, and may be applied to moving sidewalks or other conveyors. The power transmission members are not limited to chains, and may be any other suitable means.

What is claimed is:

1. A conveyor for transporting people, comprising:

a body frame;

a large number of treadboards supported on the body frame for movement along a predetermined path;

a moving handrail supported on the body frame for movement along a predetermined path;

first drive means for moving the treadboards;

second drive means for moving the handrail in interlock with the first drive means, said second drive means including a handrail drive section engaging the handrail, and means for transmitting the driving force of the first drive means to the handrail drive section, said transmitting means including a transmission shaft rotatably supported on the body frame, first and second engaging sections provided on the transmission shaft so as to be rotatably integrally therewith and spaced in the axial direction of the transmission shaft, a first power transmission member stretched between the first drive means and the first engaging section, for rotating the transmission shaft in interlock with the first drive means, and a second power transmission member stretched between the second engaging section and the handrail drive section, for driving the handrail drive section in interlock with the rotation of the transmission shaft; and means for detecting a change of the moving speed of the moving handrail by detecting a twist of the transmission shaft attributable to the difference between loads acting on the first and second engaging sections.

2. A conveyor according to claim 1, wherein said detecting means includes a first detection target fixed to the transmission shaft in the vicinity of the first engaging section and rotatable integrally with the transmission shaft, a second detection target fixed to the transmission shaft in the vicinity of the second engaging section and rotatable integrally with the transmission shaft, a first sensor for detecting the rotational phase of the first detection target, a second sensor for detecting the rotational phase of the second detection target, and comparing means for detecting the difference between the rotational phases detected by means of the first and second sensors.

3. A conveyor according to claim 2, wherein each of said first and second detection targets is in the form of a disk coaxial with the transmission shaft and having a large number of reflective portions formed at regular intervals on the outer circumferential surface thereof, said first sensor includes a photosensor facing the outer circumferential surface of the first detection target, and said second sensor includes a photosensor facing the outer circumferential surface of the second detection target.

4. A conveyor according to claim 2, which further comprises means for stopping the operation of the first drive means when a detection output from the comparing means exceeds a predetermined value.

5. A conveyor according to claim 1, wherein said detecting means includes a first sensor fixed to the transmission shaft in the vicinity of the first engaging section, for detecting a strain of the transmission shaft, a second sensor fixed to the transmission shaft in the vicinity of the second engaging section, for detecting a strain of the transmission shaft, and comparing means for detecting the difference between the strains detected by means of the first and second sensors.

6. A conveyor according to claim 5, wherein said transmission shaft includes a fixed shaft and a cylindrical rotating shaft rotatably supported around the fixed shaft and fitted with the first and second engaging sections and the first and second sensors, and said detecting means includes a plurality of ring-shaped first conductors attached to the inner circumferential surface of the rotating shaft so as to be coaxial therewith and connected to the first and second sensors, a plurality of second conductors contacting the first conductors corresponding thereto, and comparing means connected to the second conductors, for detecting the difference between output signals transmitted thereto from the first and second sensors through the first and second conductors.

7. A conveyor according to claim 5, wherein said detecting means includes first transfer means fixed to the transmission shaft and connected to the first sensor, for transferring a detection signal from the first sensor, first receiving means disposed out of contact with the transmission shaft so as to face the first transfer means, for receiving the detection signal from the first transfer means, second transfer means fixed to the transmission shaft and connected to the second sensor, for transferring a detection signal from the second sensor, and second receiving means disposed out of contact with the transmission shaft so as to face the second transfer means and adapted to receive the detection signal from the second transfer means, said first and second receiving means being connected to the comparing means.

8. A conveyor according to claim 5, which further comprises means for stopping the operation of the first drive means when a detection output from the comparing means exceeds a predetermined value.

* * * * *